United States Patent [19]

Melnyk et al.

[11] Patent Number: 5,064,509

[45] Date of Patent: Nov. 12, 1991

[54] MULTILAYER BELTS FORMED BY ELECTRODEPOSITION

[75] Inventors: Andrew R. Melnyk, Rochester; Donald S. Sypula; Joseph Mammino, both of Penfield; Ronald Jansen, Rochester; William G. Herbert, Williamson, all of N.Y.; Henry Grey, Santa Clara, Calif.

[73] Assignee: Xerox Corporation, Stamford, Conn.

[21] Appl. No.: 589,687

[22] Filed: Sep. 28, 1990

[51] Int. Cl.[5] ..... C25D 1/02; C25D 13/14

[52] U.S. Cl. ..... 204/9; 204/181.1

[58] Field of Search ..... 204/9, 181.1

[56] References Cited

U.S. PATENT DOCUMENTS

| | | | |
|---|---|---|---|
| 3,927,463 | 12/1975 | Dupree et al. | 29/447 |
| 3,950,839 | 4/1976 | Dupree et al. | 29/447 |
| 4,067,782 | 1/1978 | Bailey et al. | 204/25 |
| 4,270,656 | 6/1981 | Chesmer et al. | 198/847 |
| 4,686,016 | 8/1987 | Held | 204/25 |
| 4,747,992 | 5/1988 | Sypula et al. | 264/130 |
| 4,758,486 | 7/1988 | Yamazaki et al. | 430/56 |
| 4,772,253 | 9/1988 | Koizumi et al. | 474/266 |

FOREIGN PATENT DOCUMENTS 2189192 4/1986 United Kingdom .

OTHER PUBLICATIONS

Fluorad, Fluorochemical Surfactants, "Fluorad Fluorochemical Surfactant FC-135", Issue Date 7/86, 3M DuPont, Material Safety Data Sheet, Sep. 26, 1985, Zonyl FSC, Fluorosurfactant.

*Primary Examiner*—T. M. Tufariello

*Attorney, Agent, or Firm*—Oliff & Berridge

[57] ABSTRACT

A process for preparing a multilayered belt includes providing a mandrel having an outer electroforming surface or an inner electroforming surface; and sequentially electrodepositing both a polymer layer and a conductive layer on the electroforming surface of the mandrel to form a multilayered belt.

31 Claims, No Drawings

MULTILAYER BELTS FORMED BY ELECTRODEPOSITION

BACKGROUND OF THE INVENTION

This invention relates to a process for preparing a multilayered belt comprising at least a polymer layer and a conductive layer by electrodeposition of the layers on a mandrel.

Polymer coatings of thicknesses which are less than about 51 micrometers (2 mils) are typically used in the metal finishing industry to protect metals from corroding and to give them a decorative appearance. Coatings of thicknesses greater than about 51 micrometers are more difficult to obtain and have application in special areas such as insulating coatings in electrical applications such as dielectric receivers and also for free standing films, such as seamless belts. These thick coatings are more difficult to obtain by conventional processes such as spray or dip coating. These conventional processes require repeated applications of thin coatings to obtain thick films. Other limitations of the spray coating process are high equipment cost for air handling, spray equipment and solvent recovery. Also, this process requires extensive factory space for equipment and processing. For polymer film belts, elaborate handling procedures and machinery are also needed for removing a belt after it is formed. Thus, fabrication techniques such as spray and dip coating systems encounter sagging, multiple application steps, long curing times, sizable equipment space requirements, high cost and other associated problems.

Most belts normally have a thickness greater than about 254 micrometers (10 mils) and are usually formed by molding or lamination. Molding is carried out in complex and expensive molds. Molded articles contain flashings that require removal to achieve a smooth outer surface. Laminated belts are usually prepared by applying alternate layers of thermoplastic sheets and reinforcing fabrics. These materials are relatively thick and stiff, and are not suitable for extended cycling over small diameter pulleys or rolls. Other types of belts have been prepared by welding opposite ends of sheets together to form belts having an undesirable seam.

Originally, photoreceptors for electrophotographic imaging systems comprised selenium alloys vacuum deposited on rigid aluminum substrates. Photoreceptors have also been prepared by coating rigid substrates with photoconductive particles dispersed in an organic film forming binder. Coating of rigid drum substrates has been effected by various techniques such as spraying, dip coating, vacuum evaporation, and the like. Rigid drum photoreceptors limit copier and printer design flexibility, are less desirable for flash exposure and are expensive.

Flexible organic photoreceptors in the form of belts have recently become popular. These flexible photoreceptors are manufactured by coating a web and thereafter shearing the web into segments which are then formed into belts by welding opposite ends of the sheared web. The resulting welded seam on the photoreceptor disrupts the continuity of the outer surface of the photoreceptor and must be indexed so that it does not print out during an imaging cycle. In other words, efficient stream feeding of paper and throughput are adversely affected because of the necessity to detect a seam within the length of each sheet of paper. Seam detection is a particularly vexing problem for smaller copier and printer designs. The mechanical and optical devices required for indexing add to the complexity and cost of copiers, duplicators and printers, and reduce the flexibility of design. Welded belts are also less desirable for electrophotographic imaging systems because the seam forms a weak point in the belt and collects toner debris during cleaning, particularly with wiper blade cleaning devices. The seam and wiper blade interaction also causes a disruption in motion quality which impacts registration and timing in applications where multiple images are formed on a single belt.

Flexible seamless photoreceptor substrates enable many cost effective machine designs. Currently, flexible seamless substrates are produced by nickel electrodeposition. However, nickel belts have several disadvantages which include cost and difficulty in handling. Nickel belts are costly because the metal is expensive and thicknesses of >2 mils (50 micrometers) are required to achieve desired mechanical properties. Polymeric belts are potentially cheaper than Ni, are more flexible and are easier to handle. Various fabrication techniques have been proposed for polymeric belts including blow extrusion, spray coating, powder coating, electrodeposition, etc. A problem with polymeric belts is that they are not conducting. Some of the proposed solutions to this include loading the polymer with a conductive material such as carbon or coating a conductive layer of loaded polymer or other organic material. But these conductive materials are not as desirable as metals. One problem is that conductive (or conductively loaded) polymers have not been developed with proper blocking surfaces or layers required by photoreceptors. A thin metal coating could be applied to the polymer belt by vacuum deposition, but that process is expensive.

U.S. Pat. No. 4,686,016 discloses a method of electrodepositing a metal coating onto a surface of an endless belt. An annular bath is formed by a pair of endless belts and an aqueous electrolytic solution is filled into the annular bath. An anode is supported in the bath and one of the endless belts forms a cathode. The anode and cathode are connected to a constant voltage source and a metal coating is deposited on the belt acting as a cathode.

U.S. Pat. No. 4,758,486 discloses an endless belt shaped electrophotographic photoconductor comprising a support material and an electroconductive layer deposited thereon by vacuum evaporation. The electroconductive overcoating layer may comprise a polymeric material having a glass transition temperature of −10° C. or lower.

U.S. Pat. No. 4,270,656 discloses a method of forming a rubber and fabric feed belt comprising the steps of 1) mounting a sleeve on a mandrel, 2) placing the mandrel in a mold, 3) pouring rubber into the mold, 4) removing the formed belt, 5) subjecting the belt to a halogenation treatment, and 6) grinding the outer surface of the belt.

U.S. Pats. Nos. 3,927,463, 3,950,839, and 4,067,782 disclose various methods of forming an electroforming mandrel used in the production of endless seamless nickel xerographic belts.

U.S. Pat. No. 4,747,992 discloses a process for forming at least one thin substantially uniform coating comprising applying polymeric film forming material on a cylindrical mandrel, solidifying the fluid coating to form a solid coating and separating the uniform solid coating from the mandrel.

U.S. Pat. No. 4,772,253 and Great Britain Patent No. 2,189,192 disclose a seamless belt comprising a layer of metal 10 to 50 micrometers thick and a lining layer made of flexible material such as synthetic resin or rubber provided on the inside surface thereof. The belt is used as a substrate for a photosensitive belt for an electrostatic photographic copying machine. The lining may be prepared by coating, bonding, adhesion or other methods.

There continues to be a need for improved, flexible, multilayered seamless belts for various applications including photoreceptor and ionographic substrates and a method of cost-effectively producing the same.

SUMMARY OF THE INVENTION

It is a feature of the present invention to provide a process for fabricating improved flexible, multilayered belts which overcome the above disadvantages.

It is another feature of the present invention to provide a process for fabricating improved flexible, multilayered electrodeposited belts which avoid sagging during deposition.

It is still another feature of the present invention to provide a process for fabricating improved flexible, multilayered electrodeposited belts which eliminates the need for multiple applications of polymer material to achieve a thick film.

It is still another feature of the present invention to provide a process for fabricating improved flexible, multilayered electrodeposited belts which reduces film curing time.

It is still another feature of the present invention to provide a process for fabricating improved flexible, multilayered electrodeposited belts which avoids the need for extensive processing and equipment space and minimizes equipment complexity and cost.

It is still another object of the present invention to provide flexible multilayered seamless belts comprising a thin conductive layer and a thicker support layer.

It is still another feature of the present invention to provide a process for fabricating improved flexible, multilayered electrodeposited seamless photoreceptor and ionographic substrates which are readily removed from an electrode.

These and other features of the present invention are accomplished by providing a mandrel having an outer electroforming surface or an inner electroforming surface; and sequentially electrodepositing (in any order) a polymer layer and a conductive layer on the electroforming surface of the mandrel to form a multilayered belt. As one exemplary result, a very thin (1 micrometer or less) layer of an expensive metal (e.g., Ni) may be electrodeposited adjacent a mechanically stable polymer layer which is 75 micrometers thick or more.

A belt can thus be made with precise dimensions, smooth surface and a known conducting surface. Cost is minimized by using a common plating mandrel and low cost material polymer for the belt walls with a thin layer of the high cost material as the conductive layer.

DETAILED DESCRIPTION OF THE INVENTION

According to the present invention, a multilayered belt can be manufactured by providing a mandrel, preferably cylindrical, having an outer electroforming surface or an inner electroforming surface, and sequentially electrodepositing a polymer layer and a conductive layer on the electroforming surface of the mandrel. Through the process of electroformation, layer thicknesses can be controlled over a very broad range. For example, a very thin layer of a high cost material may be deposited subsequent to or prior to a thicker layer of a polymer.

The process can provide very thin multilayered belts which are useful and longlasting during repeated cycling over small diameter pulleys and rollers. These belts are particularly useful as photoreceptor substrates and ionographic receiver substrates. Uniform conductive layers as thin as one micrometer or thinner may be provided according to the present invention. Polymeric coatings of approximately 50 to 100 micrometers can preferably be provided as mechanical backings for the conductive layers.

Electrodeposition processes according to one embodiment of the present invention involve the use of a female mandrel comprising a cylindrically shaped (sleeve) electrode having a polished inside surface upon which film forming particles deposit out of an organic liquid dispersion to form either the conductive or polymer layer. A conductive rod is positioned as the other electrode along the axis of the female mandrel. This pair of electrodes is immersed in a dispersion of film forming particles which deposit on the inside surface of the female mandrel electrode when a low voltage is applied to the electrodes.

Continued heating removes the organic liquid dispersion medium from the resulting continuous film. The coalescence time is dependent to a high degree on the thickness of the mandrel onto which the polymer is deposited. Larger wall thicknesses require longer heating times. Thin walled mandrels are preferred as the particle deposition surface because the deposited layer of particles can be heated more rapidly by application of heat to both sides of the layer.

Belts fabricated by the process of this invention can be thin and flexible. The entire process of obtaining a thick free standing polymer belt with a thickness of about 100 micrometers or even up to about 500 micrometers (20 mils) or more is greatly simplified by the method of this invention. Layer thickness of up to about 75 micrometers may be obtained within relatively short deposition time periods. The thickness of the flexible belt depends on numerous factors, including economic considerations and the number of layers in the final product. Thus, the belt may be of substantial thickness, for example, as thick as about 500 micrometers or more, or as thin as about 1 micrometer or less, preferably about 100 micrometers. Substrates that are too thin can split and exhibit poor durability characteristics. When the substrate is excessively thick, early failure during cycling and higher cost for unnecessary material are often observed.

The conductive layer may be made of any suitable electrodepositable conductive material, such as metals, conductive loaded polymers, and the like. Metals suitable for use in the conductive layer include nickel, copper and chromium. Nickel is most preferred. Thin layers of these metals are sufficient to provide conductive layers for photoreceptor and ionographic receiver applications.

The conductive layer composition may alternatively be a dispersion of a conductive material in a polymer. For example, finely divided aluminum, titanium, nickel, chromium, brass, gold and stainless steel particles may be dispersed in a polymer. Also, carbon black, graphite and the like may be employed dispersed in a polymer.

Appropriate polymers include polymers employed in the polymeric layer described hereinbelow.

If applied to the mandrel prior to deposition of the polymer layer, the conductive layer should be releasable from the mandrel. Release may be achieved by any conventional technique such as by coating the mandrel with a release coating, adding a release agent to the conductive layer composition, and the like.

The conductive layer may vary in thickness over substantially wide ranges depending on the desired use of the final belt. Preferred thicknesses for the conductive layer generally range from about 0.03 micrometer to about 20 micrometers when the conductive layer resides outside of the electrodeposited polymer layer. When a flexible electrographic receiver is desired, the thickness of the conductive layer may be as thin as about 0.03 micrometer or as thick as about 5 micrometers. A conductive layer that is too thick tends to waste material and adversely affect belt flexibility, whereas a conductive layer that is unduly thin may not be uniformly conductive.

For photoreceptor applications, a very thin conductive layer is preferred, i.e., about 0.1 to 1 micrometer thick. Most preferably the conductive layer is metal. This in combination with a polymer layer between 50 and 100 micrometers thick provides a durable photoreceptor substrate at low cost. Low cost drums can also be made by depositing thick polymer layers.

Suitable film forming thermoplastic polymers must be capable of forming a dispersion of electrically charged, thermoplastic film forming polymer particles in an organic liquid. The expression "dispersion" as used herein is defined as fine particles having an average particle size of less than 100 micrometers in diameter distributed in a liquid medium with no direct contact between the particles. Dispersions are well known and extensively described in the literature, for example, by James S. Hampton, "Hyperdispersant Technology for Nonaqueous Coatings", Modern Paint and Coatings, June 1985, pages 46–54, the entire disclosure thereof being incorporated herein by reference.

Any suitable high molecular weight polar or nonpolar thermoplastic film forming polymer may be employed as the polymer according to the invention. Typical thermoplastic film forming polymers include chloro, bromo or fluoro substituted polyvinyl compounds such as polyvinyl fluoride (e.g., Tedlar available from E. I. du Pont de Nemours & Co.), polyvinylidene fluoride (e.g., Kynar 202 available from Pennwalt Corp.), and polyvinyl chloride; polyvinylidene chloride (available as Saran from Dow Chemical, Co., Midland Michigan) polyethylene; polypropylene; polyethers; styrene-butadiene copolymers; polybutylenes and the like; polyamides (e.g., nylon); polycarbonates (e.g., Makrolon 5705, available from Bayer Chemical Co., Merlon M39, available from Mobay Chemical Co., Lexan 145, available from General Electric Co.); polyesters (e.g., PE-100 and PE-200, available from Goodyear Tire and Rubber Co.); polysulfones (e.g., P-3500, available from Union Carbide Corp.); polysulfides; cellulosic resins; polyarylates; acrylic resins; polyarylsulfones; polyphenylenesulfides; polyurethanes; polyimides; epoxies; poly(amide-imides) (e.g., Torlon Polymer AI-830, available from AMOCO Chemical Corp.); copolyesters (e.g., Kodar Copolyester PETG 6763 available from Eastman Kodak Co.); polyethersulfones; polyetherimides (e.g., Ultem available from General Electric Co.); polyarylethers; and the like and mixtures thereof. Polycarbonate polymers may also be used, for example, 2,2-bis(4-hydroxyphenol)propane, 4,'-dihydroxy-diphenyl-1,1-ethane, 4,4'-dihydroxy-diphenyl-1,1-isobutane, 4,4'-dihydroxy-diphenyl-4,4-heptane, 4,4'-dihydroxy-diphenyl-2,2-hexane, 4,4'-dihydroxy-triphenyl-2,2,2-ethane, 4,4'-dihydroxy-diphenyl-1,1-cyclohexane, 4,4'-dihydroxy-diphenyl-β- β-decahydronaphthalene, cyclopentane derivatives of 4,4'-dihydroxy-diphenyl- β-β- decahydronaphthalene, 4,4'-dihydroxy-diphenyl-sulphone, and the like and mixtures thereof. Preferably, the substrate material is polyvinylfluoride, polyamide-imide, polyester, nylon or polymers of vinylidene fluoride (1,1 difluoroethene). Polyvinyl fluoride is most preferred.

An insulating substrate comprising an amorphous polymer such as polyvinylfluoride, polyamide-imide, polyimide, polyurethane or polyvinylidene fluoride having a molecular weight of from about 35,000 to about 1,500,000 is particularly preferred because the resulting layer is mechanically strong and resists crazing and cracking when exposed to solvents employed in any subsequently applied coatings such as during the fabrication of electrographic imaging members.

Generally, the film forming polymer particles in the dispersions have an average particle size between about 0.01 micrometer and about 10 micrometers to remain in dispersion for practical periods of time. The dispersed polymer particles may be solids. Particles with a small diameter and large surface area form better dispersions than particles with a low surface area and large diameter. The dispersed polymer particles may be of any suitable shape. Typical shapes include spherical, ellipsoid, angular, acicular, platelet, polyhedral, irregular, porous and irregular, permeable and irregular, and the like.

The dispersions employed in the process of this invention should be substantially free of polymer particle agglomerates. The expression "substantially free of polymer particle agglomerates" as used herein is defined as free of any polymer particle agglomerates having a size larger than twice the average particle size of polymer particles in the dispersion. Agglomerates having a size larger than twice the average particle size of polymer particles in the dispersion can deposit onto the surface of a mandrel electrode, and cause an irregular surface to form on the belt.

The polymer layer preferably has a thickness of between 5 and 100 micrometers, between 40 and 60 being more preferred. The most preferred thickness for a dielectric receiver is about 50 micrometers. For photoreceptor substrates, thicknesses of between 50 and 100 micrometers are preferred, about 75 micrometers being most preferred.

The film forming particles must acquire a sufficient electrostatic charge in the liquid dispersion medium for electrodeposition. A charge control agent may be added to promote acquisition of sufficient electrostatic charge to allow the particles to migrate under the influence of an electric field. Typical charge control agents include the dispersant additives including, for example, ZONYL FSC (fluorosurfactant available from E. I. du Pont de Nemours & Co.), Fluorad TM Fluorochemical Surfactant FC-135 (fluorinated alkyl quaternary ammonium iodide available from 3M Company), and other fluoro organic surfactants which are cationic and miscible with the liquid phase of the dispersion, and the like.

Generally, the relative amount of charge control agent added to the dispersion may be up to about 10 percent by weight based on the weight of dispersion solids. This charge control agent may also perform other functions such as those of a release agent or dispersion stabilizer. Sufficient charge control agents should be added to the dispersion to impart a charge to the film forming particles sufficient to achieve a deposition rate of at least about 0.5 micrometer per minute unlimited by the coating thickness of uncoalesced particles. Generally, between about 0.001 percent and about 10 percent by weight based on the weight of dispersion solids of charge control agent is employed if the film forming particles are nonpolar polymers. If desired, the addition of charge control agents may be omitted for polar polymers.

The addition of charge control agents can also contribute to agglomerate free coatings. Thus, incorporation of suitable additives such as lower alcohols, e.g. methanol, ethanol and isopropanol, or cationic surfactants can enhance the polymer particle deposition rate and minimize the formation of agglomerates.

After acquiring an electrostatic charge, the film forming polymer particles should also be capable of migrating through the organic liquid medium of the dispersion under the influence of an electric field to form a uniform particulate coating on an electrode. Preferably, the film forming polymer particles are also substantially insoluble in the organic liquid dispersion medium at electrodeposition temperatures but soluble in the organic liquid medium at elevated temperatures after deposition on an electrode. The expression "substantially insoluble" is defined as a state of insolubility where the polymer particles do not form sintered agglomerates in the organic liquid dispersing medium at electrodeposition temperatures. During heating, the particles should be solubilized by the liquid medium to form a viscous continuous sol layer of the solubilized polymer particles and finally form a dry, continuous polymer layer when continued heating evaporates the organic liquid dispersion medium. The word "sol" as used herein is defined as a high viscosity mixture in which the polymer is molecularly dispersed in the liquid dispersion medium.

If desired, the film forming polymer particles may be only partially polymerized so as to have reactive groups available for further reaction during final curing. These partially cured polymer particles have a molecular weight of at least about 35,000 and may be subsequently reacted by crosslinking, chain extension or other suitable mechanisms to increase the weight average molecular weight of the polymer when the particulate coating on the mandrel is heated to coalesce the particles to form a sol coating and to evaporate the organic liquid to form a dry layer. The polymer sol coating under these conditions does not sag and therefore layers of uniform thickness are formed.

Typical examples of curable film forming polymer materials include prepolymers of polyimides, poly(amide-imide)s, polyurethanes, epoxy resins, polyesters, acrylic resins, alkyds and the like. Depending on the nature of the polymer and catalyst employed, curing may be effected at room temperature (if deposition is conducted below room temperature) or with the application of heat, light and/or other radiation.

The polymer deposition rate is affected by various factors such as the concentration of the dispersion. Generally, the dispersions comprise between about 0.5 percent by weight and about 60 percent by weight film forming polymer particles based on the total weight of the dispersion with the remainder being primarily the organic liquid dispersion medium and up to about 10 weight percent additive For optimum results, the amount of film forming particles in the dispersion is between about 10 percent and about 20 percent by weight based on the total weight of the dispersion. When the concentration of the film forming polymer particles in the case of polyvinyl fluoride particles drops below about 10 percent by weight based on the total weight of the dispersion, the deposition rate decreases noticeably. When the concentration of polyvinyl fluoride film forming polymer particles exceeds about 60 percent by weight, the deposition rate is high but the layer thickness becomes nonuniform and uneven and too sensitive to polyvinyl fluoride particle concentration variations and thus the process is difficult to control.

Conductively loaded polymer dispersions can be used to prepare a conductive layer by the electrodeposition process. The polymer dispersion is as described above and includes suitable film forming thermoplastic polymer and conductive particles in an organic liquid medium. Any suitable high molecular weight polar or nonpolar thermoplastic film forming polymer may be employed as described above as the polymer according to the invention. The conductive particles can be finely divided aluminum, titanium, nickel, chromium, brass, gold, stainless steel, carbon black, graphite and the like. Carbon black is preferred since it is inexpensive and readily available in submicron particle size. Typical carbon blacks are Black Pearls 2000 and Vulcan XC72R (available from Cabot Corp. of Boston Mass.) and others can be used. The carbon black is dispersed in with the dispersion of polymer particles using an attritor, paint shaker or other suitable dispersion means. The loading of the carbon particles in the polymer dispersion solids is from about 5 to 15 weight percent and preferably about 6 to 10 weight percent. Too low of a loading of conductive particles in the dispersion will give an electrodeposited film which has low conductivity, whereas too high of a loading will prevent electrodeposition of the dispersion of polymer and conductive particles. Thus, there is an optimum loading range that gives a conductive polymer film after deposition and thermal processing.

Any suitable organic liquid dispersion medium may be employed in the plating bath to disperse the film forming polymer particles. The organic liquid dispersion medium should not dissolve the dispersed film forming particles at electrodeposition temperatures. The particles might otherwise agglomerate. In a preferred embodiment, at least one component of the medium, however, should sufficiently dissolve the particles at elevated temperatures below the boiling point of the solvent component of the organic liquid dispersion medium to form a sol. Polymers such as polyvinylfluoride are substantially insoluble in organic liquids such as propylene carbonate solvent at room temperature but at elevated temperatures will coalesce and form a sol which, upon drying, forms a solid layer.

Because of the high molecular weight of the polymers employed and the minimal residual amount of liquid dispersion medium deposited, a viscous sol coating is formed at elevated temperatures rather than a free flowing dilute solution. Because the amount of residual liquid dispersion medium clinging to the deposited particles is relatively small, a viscous sol is formed at elevated temperatures.

Continuation of the heating evaporates the residual organic liquid dispersion medium and a continuous, homogeneous, dry polymer layer is formed. Sol formation should occur below the boiling point of the solvent component of the organic liquid dispersion medium. Thus, the molecular weight of the polymers, the liquid dispersion medium components and elevated temperature are selected to achieve a high viscosity sol to avoid sagging of freshly deposited layers.

A conductively loaded polymer dispersion can be used to prepare a conductive layer by an electrodeposition process similar to the one discussed above in connection with the polymer layer. The polymer dispersion of thermoplastic film forming and conductive particles is electrodeposited onto a mandrel surface. This can have a release coating or the dispersion can contain a material that aids in the release of the polymer film from the mandrel. The properties of the polymer dispersion are such that it functions in the same manner and has the same composition as described above without the conductive particles. The presence of the conductive carbon black particles does not change the deposition and sol formation properties of the dispersion but only results in a change in the coalescence part of the thermal processing. The mandrel with the electrodeposited thermoplastic and carbon black particles must not be enclosed during the initial heating phase to retain the organic liquid vapors for complete coalescence. To prevent voids in the film due to the effect of the presence of the carbon black particles in the sol coating, less solvent must be present to enable for adequate sol formation. The heating time for the thermal processing of the deposited dispersion of polymer and carbon black particles for film formation is about the same as that for the deposited dispersion without the carbon particles.

The solubility of the polymer particles in the solvent component of the organic liquid dispersing medium should be greater than about 1 percent by weight based on the weight of the deposited particles at temperatures employed during the heating step to accelerate coalescence at elevated temperatures (sol stage). Further, when the solubility of the thermoplastic particles in the solvent component of the organic liquid dispersing medium is greater than about 1 percent, such solubility of the polymer particles in the clinging solvent results in penetration of the solvent into the deposited particles to form a molecular dispersion in the solvent which forms the sol. With solvent molecules present between polymer molecules, the latter freely entangle with adjacent polymer molecules which are in a similar environment. Hence coalescence occurs to form the sol. Complete solubilization with a resulting low viscosity cannot occur because of the limited amount of residual solvent present and because the polymer molecules of the organic thermoplastic particles are sufficiently large to avoid becoming completely free of entanglement with adjacent polymer molecules. High viscosity is a highly preferred property for good coating and layer formation on the electrode because low viscosity of a polymer solution may cause undesirable sagging to occur. In layer formation, the minimum solubility required should be just sufficient to coalesce the polymer particles into a continuous sol.

Thus, the polymer particles are substantially insoluble in the liquid dispersion medium at electrodeposition temperatures. When heated to a solvation temperature, sufficient solvent penetration into the particles occurs to cause entanglement of polymer molecules on adjacent particles to facilitate sintering, coalescence and sol formation. Below the solvation temperature, the polymer particles are segregated. Above the solvation temperature, the polymer particles form a molecular dispersion in the residual solvent and mingle to form a sol. Further heating is necessary to remove the solvent from the sol coating.

Any suitable cylindrical electrode material having an electrically conductive surface may be used for the mandrel. The mandrel is preferably dimensionally and thermally stable at the processing temperatures utilized. It also should be insoluble in organic liquid dispersion media employed and should not react chemically with the film forming particles or other components of the dispersion mixture. The mandrel may be uncoated or, if desired, be coated with a suitable release coating prior to applying coatings that are used to form the ultimate belt. Typical metallic electrode materials include aluminum, stainless steel, nickel, chromium, copper, gold, brass, and the like. Electrodes having an outer surface of steel, nickel, aluminum, chromium, gold or graphite are particularly preferred because they contribute to the release of the completed layer after it is heated and cooled. A release coating on the mandrel is preferably employed for the removal of the film from the mandrel when the dispersion consists of polymer and carbon black particles at a loading of carbon black particles of greater than about 6 to 8 weight percent. When nickel is the conductive coating on the mandrel, the mandrel is preferably made from aluminum with a chromium metal finish or some other suitable composition.

The different layers are preferably electrodeposited from different baths.

In one embodiment of the present invention, a multilayered belt particularly useful as an electrographic receiver is formed by providing an electrode comprising a female mandrel coaxially spaced apart from another electrode in a bath comprising a dispersion of electrically charged, thermoplastic film forming polymer particles in an organic liquid dispersion medium. The polymer particles preferably have a weight average molecular weight of at least about 35,000 and are substantially insoluble in the organic dispersion liquid medium at electrodeposition temperatures and sufficiently soluble in the organic dispersion liquid medium at elevated temperatures to coalesce and form a viscous coating An electric field is applied across the electrodes until a thick, substantially uniform deposit of polymer particles forms on the interior surface of the mandrel. The sleeve electrode bearing the deposit of polymer particles and residual liquid dispersion medium is removed from the bath and heated to initially solubilize the polymer particles and the residual organic liquid dispersion medium, to form a coalesced, continuous, viscous sol coating. The heating may be continued to evaporate the residual organic liquid dispersion medium and form a continuous, solidified, dry, cylindrical polymer layer. Preferably, prior to complete evaporation of the organic liquid dispersion, the plating bath is changed to provide a dispersion of metal or conductive, loaded polymer particles which may be deposited on the polymeric layer to complete the electrographic receiver. Only a thin layer of the metal or conductive, loaded polymer is necessary to form an effective electrographic receiver. The conductive layer is applied prior to complete evaporation of the dispersion so that the polymer layer remains conductive during deposition of the conductive layer. This aids in the deposition of a thin, uniform conductive layer.

The distance between the mandrel and the other electrode is typically from about 1 cm to about 30 cm. Generally, it appears that electrode spacing does not have a significant effect on the quality of the deposition. However, an ultimate limiting spacing may exist where the efficiency would decrease beyond the point of practicality. The voltage applied to the electrodes depends upon various factors such as the spacing between the electrodes, the deposition area of the electrode where the deposits form, electrical resistance of the dispersion, electrical charge on the particles, and temperature. In a typical example where the electrode spacing is about 14.6 cm and the deposition area is about 3,442.2 $cm^2$, the voltage can be, for example, between about 5 volts and about 24 volts. Generally, sufficient voltage is applied across the electrodes when an adequate deposition rate of at least about 0.5 micrometer per minute is achieved. The optimum applied voltage varies with the materials utilized. Preferably, the lower end of the usable applied voltage range is preferred to minimize the formation of agglomerates.

The concentration of the dispersion affects the rate of deposition. For example, increasing the dispersion concentration of a PVF dispersion by a factor of two increases the layer thickness from about 25 micrometers to 50 micrometers for 3 minute deposition periods at −24 volts. Thus, the concentration of the particles in the dispersion is preferably between about 1 percent by weight and about 35 percent by weight based on the total weight of the dispersion. For PVF, the optimum range is between about 10 percent by weight and about 20 percent by weight based on the total weight of the dispersion.

Electrodeposition provides thick polymer layers which can be made uniform without any sagging of the electrodeposited coating. The reason for this is believed to be that the process forms a high solids coating of polymer particles on the surface of the electrode which is held there by the electrical characteristics of the dispersion medium clinging to the particles and their surface charge.

A particularly preferred electrodeposition process involves the use of a female mandrel comprising a cylindrically shaped electrode having a polished inside surface upon which film forming particles deposit. A conductive rod is positioned as the other electrode along the axis of the female mandrel. This pair of electrodes is immersed in a dispersion of film forming particles which deposit on the inside surface of the female mandrel electrode when a low voltage is applied to the electrodes. For example, in the electrodeposition of polyvinyl fluoride to form seamless belts on the interior surface of a cylindrically shaped electrode (female mandrel) having a diameter of 26.97 cm (10.62 in) and length of 152.4 cm (16 in), typical operating conditions include a low voltage of about −24 volts and a current of about 25 mA for a deposition time of about 7 minutes. Heating to remove the liquid dispersion medium from the film or belt should be conducted at a rate sufficient to evaporate a sufficiently large amount of solvent in a reasonable time to form a uniform layer without bubble formation. A suitable set of parameters for the electrodeposition of the dispersion of polymer and carbon black particles to form a conductive layer is a voltage of 24 volts, and a current of about 11.5 ma for a deposition time of about 5 min. The deposited layer is heated in a similar manner as described above for the formation of a solid polymer layer from deposited polymer particles.

The forces that contribute to adhesion of the belt to the mandrel comprise a component which includes the wetting of the polymer onto the mandrel. This wetting component can be driven by factors such as acid/base interactions, van der Waals' forces, electrostatic attraction, and surface energy relationships. A force which acts to overcome these adhesive forces and drives the release of the belt from the mandrel is that which results from the relaxation of the belt during the cooling process. When belts are formed on the inside surface of a mandrel, shrinkage of the electrodeposited layers after drying and cooling can greatly facilitate belt removal. The heating of polymer particles to initially coalesce them into a uniform, continuous sol layer on the electrode occurs at an elevated temperature. Upon further heating to dry the deposited layers followed by cooling, the belt shrinks. This develops a force between the belt and the electrode. When this force is greater than the adhesive force that holds the belt to the electrode, as results with cooling, the belt is released from the electrode. Release may be augmented by supplying release materials to the electrode, the belt, or both. The difference in surface energy between the electrode and the belt appears to be a major component which contributes to the adhesive force that holds the belt to the electrode. Belt material shrinkage due to drying, crosslinking, and the coefficient of expansion properties of both the electrode and the final belt may be utilized to facilitate removal of the belt from an electrode.

The belt formation can be done on a mandrel with a layer of metal (e.g. Ni) being deposited initially to form a conductive layer. The mandrel is typically made from nickel with a thin wall and smooth finish and it has a chromium metal finish to facilitate deposition and removal of the belt from the mandrel. The deposition of the conductive metal layer such as nickel onto the metal mandrel is made from a plating bath consisting of a nickel sulfamate solution which has been heated to an appropriate elevated temperature to obtain a good quality metal deposit. The adhesion of the metal layer onto the metal mandrel at this elevated temperature is due to intimate physical contact. The polymer dispersion particles are then deposited onto the conductive metal layer and thermally coalesced to give a dry polymer coating.

It is believed that the forces that contribute to adhesion of the belt to the mandrel comprise a component which includes the wetting of the polymer onto the mandrel. This wetting component can be driven by factors such as acid/base interactions, van der Waals' forces, electrostatic attraction, and surface energy relationships. A force which acts to overcome these adhesive forces and drives the release of the belt from the mandrel is that which results from the relaxation of the belt relative to the mandrel during the cooling process. The deposited metal layer (e.g. Ni) has a different coefficient of thermal expansion as compared to the metal mandrel which can be made from aluminum with a chromium finish. Shrinkage of the polymer layer occurs during cooling, but with a metal layer of sufficient thickness adjacent to the mandrel, release of the completed belt occurs from the mandrel due to the shrinkage of the mandrel relative to that of the belt.

For belt materials that are difficult to remove from a mandrel, it is preferred that they be electrodeposited on the inner surface of the mandrel after the latter has been coated with a release coating. If desired, a fluid may be introduced between the belt and the mandrel prior to removing the belt from the mandrel further reducing adhesion between the mandrel and the electrodeposited belt. The fluid may comprise one or more jets of air or a liquid introduced at one or both ends of the mandrel between the electrode surface and the belt. The jets of fluid may be heated or at room temperature. Moreover, the jets of fluid can be injected between the belt and the mandrel surface while the deposited belt material is at a temperature above the apparent $T_g$ of the solid coating layers of the belt.

When employed, rapid quenching of the coated mandrel by immersion in a liquid bath can serve the dual purpose of cooling the coating and introducing a fluid between the coating and mandrel prior to removing the belt from the mandrel. Water from a water bath penetrates between the belt and mandrel to give release with no stretch marks. Ionized air or moisturized air may also be utilized to promote removal of the belt from the mandrel by neutralizing static charges on the belt. In addition, ultrasonic energy may be applied to the mandrel and/or belt to facilitate removal of the belt.

Belts may, if desired, be cleaned prior to coating by any suitable technique such as by washing in water alone, with soap and water, solvents, air impingement, and the like to remove surface contamination such as residual release material, dirt, oils, fibers, and the like. After cleaning, the belt formed may be corona treated, etched, flame treated and the like to improve adhesion of subsequently applied coatings.

According to an embodiment of the present invention, a multilayer belt can be made by electrodepositing a polymer layer such as polyvinyl fluoride to an appropriate thickness on the inside of a mandrel and partially coalescing the layer at a high temperature but not sufficient to remove all of the solvent and render the layer non-conductive. Then a conductive layer of metal or conductive particles dispersed in a polymer can be electrodeposited onto this followed by further heating to completely coalesce the layer. This gives an insulating polymeric layer with a conductive backing particularly useful for ionographic printing. Also, these devices can be made by making a seamless belt by electrodepositing a polymer such as polyvinyl fluoride and coalescing it followed by the application of a conductive layer to the inside of the polyvinyl fluoride layer by electrodeposition.

To use polyvinyl fluoride (PVF) seamless belts as photoreceptor substrates or dielectric receivers requires that they have a conductive ground plane either on the top outside surface or on the inside surface. To accomplish this, the inventors of the present invention have found that PVF seamless belts may be prepared by the electrodeposition process wherein the conductive ground plane consists of carbon black (10 percent by weight) dispersed in a PVF dispersion.

EXAMPLE I

To prepare PVF seamless belts with the conductive layer on the inside, a PVF layer was electrodeposited and coalesced first, then a carbon black/PVF dispersion was applied to the inside and coalesced. The PVF dispersion contained 400 ml of PVF concentrate from the Du Pont Co. at 33 percent weight solids and 400 ml of propylene carbonate with 0.41 gms (0.25 percent weight) FC-135 as the conditioning additive to prevent agglomerate formation. The deposition conditions with the 4.75 inch diameter mandrel for the PVF clear coating were a voltage of 24 volts, current of 56 ma. and deposition time of 4.5 min. This coating was coalesced at 180° C. for 5 min. with the mandrel covered and 10 min. open to allow for solvent evaporation. The carbon black dispersion was applied to the inside of the PVF clear coating with a brush applicator. This dispersion consisted of 100 gms of PVF concentrate from the Du Pont Co., 400 gms of propylene carbonate and 6.6 gms of Black Pearls 2000 carbon black from Cabot Corp. The coalescense conditions were a temperature of 180° C. for 5 min. with the mandrel covered and 30 min. open. This application was repeated to give complete but thin coverage of the conductive layer. The film was easily removed from the inside of the mandrel after cooling to room temperature. The thickness of the belt was about 3.75 mils and the quality was good but some brush marks were present on the conductive layer.

EXAMPLE II

To prepare a PVF seamless belt with the conductive layer on the outside, a carbon black/PVF dispersion was applied to the inside of a mandrel and coalesced, then a PVF layer was electrodeposited onto this conductive layer and coalesced. The carbon black/PVF dispersion was of the same composition as in Example I as was the PVF clear dispersion. The carbon black/PVF dispersion was applied to the inside of the mandrel using a brush applicator. The coating was coalesced at 180° C. for 5 min. covered and 10 min. open. This application was repeated to obtain uniform but thin coverage on the inside of the mandrel. The clear PVF coating was electrodeposited onto this conductive layer using a voltage of 24 volts, current of 30 ma and time of 4 min. This coating was coalesced at 180° C. for 5 min. covered and 10 min. open. The completed belt film easily released from the mandrel and the quality was good with a thickness of about 3.5 mils.

EXAMPLE III

To prepare a PVF seamless belt with a nickel metal conductive layer on the outside, the nickel metal layer was electroformed onto the inside of the mandrel first followed by the electrodeposition and coalescence of the PVF layer. The mandrel was a 10.75 inch diameter nickel sleeve with a wall thickness of 15 mils and length of 17 inch and it had a chromium metal finish plated on the inside surface. The nickel bath which was used for the electroforming of the nickel conductive layer consisted of a nickel sulfamate solution and the electroforming conditions were a current of 60 amperes for 50 min. which gave a nickel metal thickness of 0.25 mils on the inside of the mandrel. The PVF dispersion consisted of 11.6 liters of PVF concentrate at 33 percent weight solids from the Du Pont Co., 14.9 liters of propylene carbonate and 33.1 ml of acetic acid. The anode was a 2 inch diameter titanium pipe that was the length of the nickel mandrel. The deposition conditions were 24 volts for 4 min. and the coalescence was at 180° C. for 15 min. The thickness of the PVF layer was about 4.75 mils and the surface quality was good but edge curl was present due to shrinkage of the PVF coating.

Although the invention has been described with reference to specific preferred embodiments, it is not intended to be limited thereto; rather those skilled in the art will recognize that variations and modifications may be made therein which are within the spirit of the invention and within the scope of the appended claims.

What is claimed is:

1. A process for preparing a multilayered belt comprising at least a polymer layer and a conductive layer, said process comprising:

a) providing a mandrel having an electroforming surface;

b) sequentially electrodepositing said polymer layer and said conductive layer on said electroforming surface to form said multilayered belt; and c) removing said multilayered belt from said mandrel.

2. A process as in claim 1, wherein said conductive layer is electrodeposited prior to said polymer layer and said electroforming surface is an outer surface of said mandrel.

3. A process as in claim 1, wherein said conductive layer is electrodeposited subsequent to said polymer layer and said electroforming surface is an inner surface of said mandrel.

4. A process as in claim 1, wherein said conductive layer is electrodeposited prior to said polymer layer and said electroforming surface is an inner surface of said mandrel.

5. A process as in claim 1, wherein said conductive layer is electrodeposited subsequent to said polymer layer and said electroforming surface is an outer surface of said mandrel.

6. A process as in claim 1, wherein said polymer layer is electrodeposited from an organic liquid dispersion medium.

7. A process as in claim 6, wherein said dispersion medium comprises polymer particles and a charge control agent.

8. A process as in claim 7, wherein said charge control agent is present in an amount of up to about 10% by weight based on the weight of dispersion solids.

9. A process as in claim 6, wherein said dispersion medium further comprises at least one member selected from the group consisting of methanol, ethanol, isopropanol and cationic surfactants.

10. A process as in claim 6, wherein said dispersion medium comprises polyvinylfluoride and propylene carbonate.

11. A process as in claim 10, wherein said polyvinylfluoride is present in said dispersion medium in an amount of between 10 and 20 percent by weight based on the total weight of the dispersion medium.

12. A process as in claim 11, wherein said polyvinylfluoride is present in an amount of about 17% by weight based on the total weight of the dispersion medium.

13. A process as in claim 1, wherein said polymer layer comprises a halo-substituted polyvinyl compound.

14. A process as in claim 13, wherein said halo-substituted polyvinyl compound is polyvinyl fluoride.

15. A process as in claim 1, wherein said polymer layer comprises a polyamide-imide.

16. A process as in claim 1, wherein said conductive layer comprises at least one member selected from the group consisting of nickel, copper and chromium.

17. A process as in claim 16, wherein said metal is nickel.

18. A process as in claim 1, wherein said conductive layer comprises carbon black and a polymer.

19. A process as in claim 1, wherein said conductive layer has a thickness of from about .1 to 10 micrometers and said polymer layer has a thickness of from about 5 to 100 micrometers.

20. A process for preparing a dielectric receiver comprising at least a polymer layer and a conductive layer, said process comprising:

a) providing a mandrel having an electroforming surface;

b) sequentially electrodepositing said polymer layer and said conductive layer on said electroforming surface to form said dielectric receiver; and c) removing said dielectric receiver from said mandrel.

21. A process as in claim 20, wherein said conductive layer is electrodeposited prior to said polymer layer and said electroforming surface is an outer surface of said mandrel.

22. A process as in claim 20, wherein said conductive layer is electrodeposited subsequent to said polymer layer and said electroforming surface is an inner surface of said mandrel.

23. A process as in claim 20, wherein said conductive layer has a thickness of from about 1.0 to about 5.0 micrometers.

24. A process as in claim 20, wherein said polymer layer has a thickness of from about 5 to about 100 micrometers.

25. A process as in claim 24, wherein said polymer layer has a thickness of about 50 micrometers.

26. A process as in claim 25, wherein said conductive layer has a thickness of about 1 micrometer.

27. A process for preparing a photoreceptor substrate comprising at least a polymer layer and a conductive layer, said process comprising:

a) providing a mandrel having an electroforming surface;

b) sequentially electrodepositing said polymer layer and said conductive layer on said electroforming surface to form said photoreceptor substrate; and c) removing said photoreceptor substrate from said mandrel.

28. A process as in claim 27, wherein said conductive layer is electrodeposited prior to said polymer layer and said electroforming surface is an inner surface of said mandrel.

29. A process as in claim 27, wherein said conductive layer is electrodeposited subsequent to said polymer layer and said electroforming surface is an outer surface of said mandrel.

30. A process as in claim 27, wherein said conductive layer has a thickness of from about 0.1 to about 1 micrometer and said polymer layer has a thickness of from about 50 to about 100 micrometers.

31. A process as in claim 30, wherein said conductive layer has a thickness of about 1 micrometer and said polymer layer has a thickness of about 75 micrometers.

* * * * *